US007077311B1

(12) United States Patent
Conklin et al.

(10) Patent No.: US 7,077,311 B1
(45) Date of Patent: Jul. 18, 2006

(54) DOCUMENT TRANSPORT CONTROL SYSTEM

(75) Inventors: David C. Conklin, Keller, TX (US); Bret Stubbs, Richardson, TX (US)

(73) Assignee: BancTec, Inc., Irving, TX (US)

( * ) Notice: Subject to any disclaimer, the term of this patent is extended or adjusted under 35 U.S.C. 154(b) by 422 days.

(21) Appl. No.: 10/694,836

(22) Filed: Oct. 29, 2003

(51) Int. Cl.
*G06F 17/00* (2006.01)

(52) U.S. Cl. ..... 235/375; 709/203; 709/225; 347/213; 347/19; 358/403; 358/1.13

(58) Field of Classification Search ..... 235/375; 709/203, 228; 347/213, 19; 358/403, 1.13
See application file for complete search history.

(56) References Cited

U.S. PATENT DOCUMENTS 4,442,769 A * 4/1984 Kallin ..... 101/93.19
5,701,548 A * 12/1997 Okatani ..... 399/8
6,424,429 B1 * 7/2002 Takahashi et al. ..... 358/1.16
2002/0059366 A1 * 5/2002 Yap ..... 709/203
2002/0170367 A1 * 11/2002 Lieber et al. ..... 73/866.5
2004/0128389 A1 * 7/2004 Kopchik ..... 709/228
2005/0128237 A1 * 6/2005 Otsuki ..... 347/19
2005/0151823 A1 * 7/2005 Botten et al. ..... 347/213
2005/0231749 A1 * 10/2005 Narusawa et al. ..... 358/1.13

* cited by examiner

*Primary Examiner*—Ahshik Kim
*Assistant Examiner*—Allyson N Trail
(74) *Attorney, Agent, or Firm*—Locke Liddell & Sapp, LLP

(57) ABSTRACT

A document transport control system for controlling the throughput rate of the document transport, the document transport has a preset throughput rate. The system includes a smart card for storing data including a throughput rate which is greater than the preset throughput rate. A card reader reads data stored on the smart card. A controller is responsive to the data read by the smart card reader for changing the preset throughput rate to the throughput rate stored on the smart card.

10 Claims, 2 Drawing Sheets

DOCUMENT TRANSPORT CONTROL SYSTEM

TECHNICAL FIELD OF THE INVENTION

The present invention relates to document transports, and more particularly to a document transport control system utilizing a smart card.

BACKGROUND OF THE INVENTION

Document transports are utilized for transporting documents along a predetermined path along which components such as, for example, cameras, printers, document readers and sorters are disposed for the processing of documents. A document transport typically operates at set speeds, inches per second, but at various document throughput rates controlled by the rate at which documents are fed into the transport, and the speeds at which transport belts are operated. As used herein, the term "throughput rate" is determined by a combination of the document feed rate and document transport belt speeds, as measured in terms of documents per minute transported along the document transport.

Pricing of document transports is based, in part, on the throughput rate of the transport, placing the lowest throughput rates at the lowest price. User's purchase the low throughput rate transports due to lower volumes or tighter budget constraints. However, on occasion a user with a low throughput rate transport will experience higher volumes and therefore has a need for a higher throughput transport. Periods of usage at a high volume justify a higher cost transport, but the periods of high volume usage are unpredictable. Therefore, a need exists for a transport that can allow a user to selectively control the throughput rate of the transport at higher throughput rates than which the transport was originally configured to operate.

SUMMARY OF THE INVENTION

In accordance with the present invention, a document transport control system for controlling the throughput rate of the document transport is provided. The document transport has a preset throughput rate. The system includes a smart card for storing data including a throughput rate which is greater than the preset throughput rate. A card reader reads data stored on the smart card. A controller is responsive to the data read by the smart card reader for changing the preset throughput rate to the throughput rate stored on the smart card.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
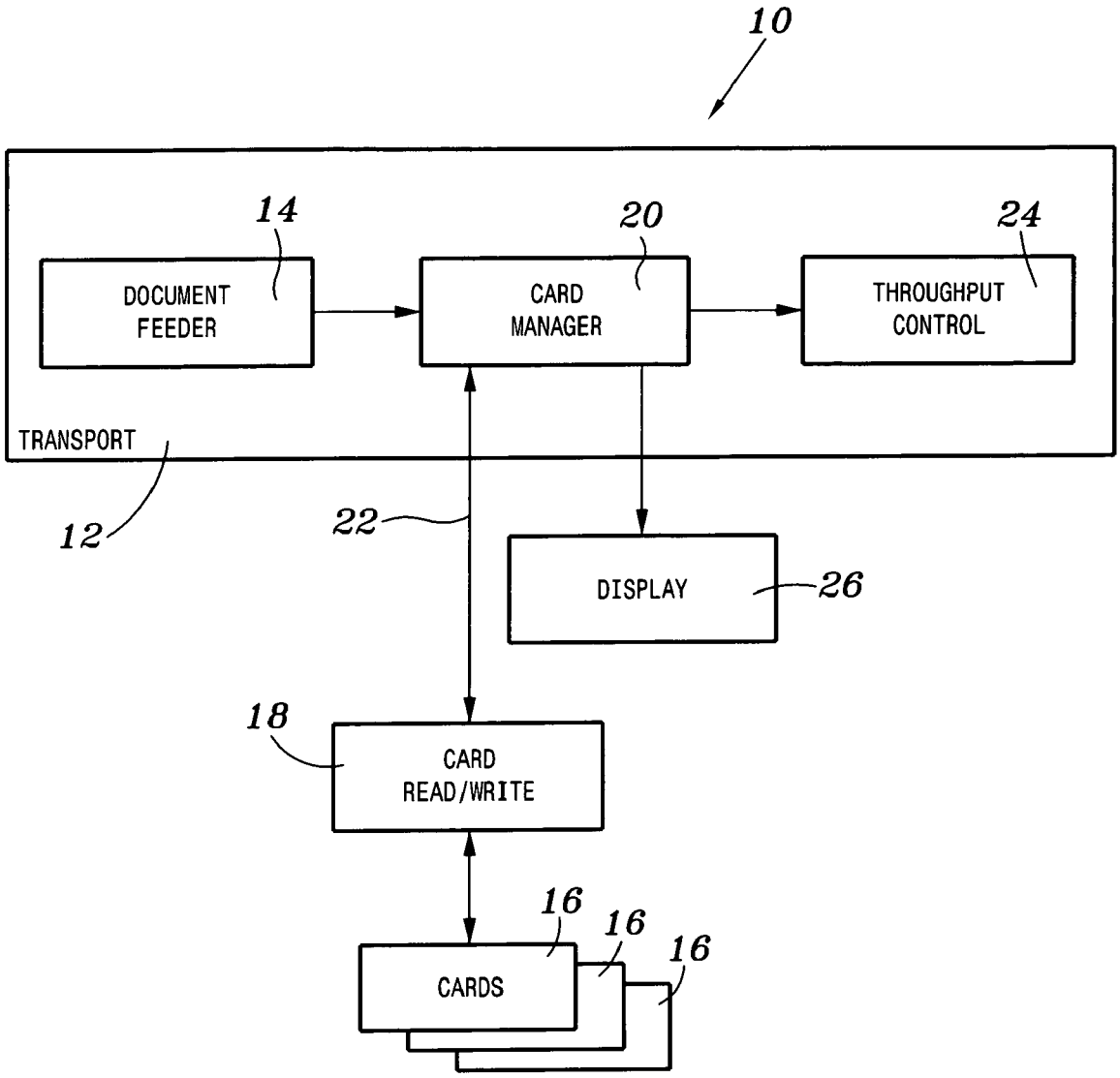
FIG. 1 is a block diagram of the present document transport control system.

Referring to FIG. 1, a block diagram of the present document transport control system is illustrated, and is generally identified by the numeral 10. System 10 includes a transport 12 for transporting documents along a path of the transport. Documents are initially fed from a document feeder 14 into transport 12.

System 10 includes the use of one or more smart cards 16 which may include, for example, a microprocessor, memory storage and a battery such as, for example, a smart card manufactured and sold by Seimens AG, Model SLE4442, EEPROM Write Protect Function and Programmable Security Code Smart Card. Smart card 16 includes memory storage for storing data including a throughput rate and a number or count indicating the quantity of documents that can be transported by document transport 12 at the smart card 16 stored throughput rate. Additional data stored on smart card 16 may include, for example, a customer identification number, a card 16 serial number, and a transport 12 serial number.

Cards 16 are read on a card reader 18. Card reader 18 also writes data to card 16. Card reader 18 may comprise, for example, a smart card reader/writer manufactured and sold by Advanced Card Systems Ltd., Model ACR30. The output of card reader 18 is applied to a card manager 20 via, for example, an RS232 serial link 22. Card manager 20 receives the throughput rate stored on card 16 and provides signaling to a throughput control 24 for changing the throughput rate of transport 12. Throughput control 24 includes servo motors and other control devices for controlling belt speeds of transport 12.

Card manager 20 also controls a display 26 for displaying the throughput rate of a card 16 as well as the count of documents to be transported via transport 12 remaining on a card 16. Card manager 20 decrements the count of the quantity of documents stored on a smart card 16 as each document is transported along transport 12 via link 22 and card read/write 18.

Cards 16 each include a predetermined level of a throughput rate such that a user may employ multiple cards 16, each having a different level above the transport 12 predetermined or preset throughput rate established at the time the transport is purchased by the user. For example, three different card 16 may each have stored therein a different level of throughput rates, each throughput rate being incrementally greater, and all throughput rates being greater than the preset throughput rate of transport 12. Cards 16 are utilized for controlling the throughput rate of transport 12 so long as the document count remaining on the card 16 is greater than zero, after which the card can no longer be utilized to activate transport 12. Card manager 20 functions to verify that cards 16 have a sufficient quantity of documents remaining in the document count. Card manager 20 also determines whether a specific card is useable on a specific transport 12.

Figure 2:
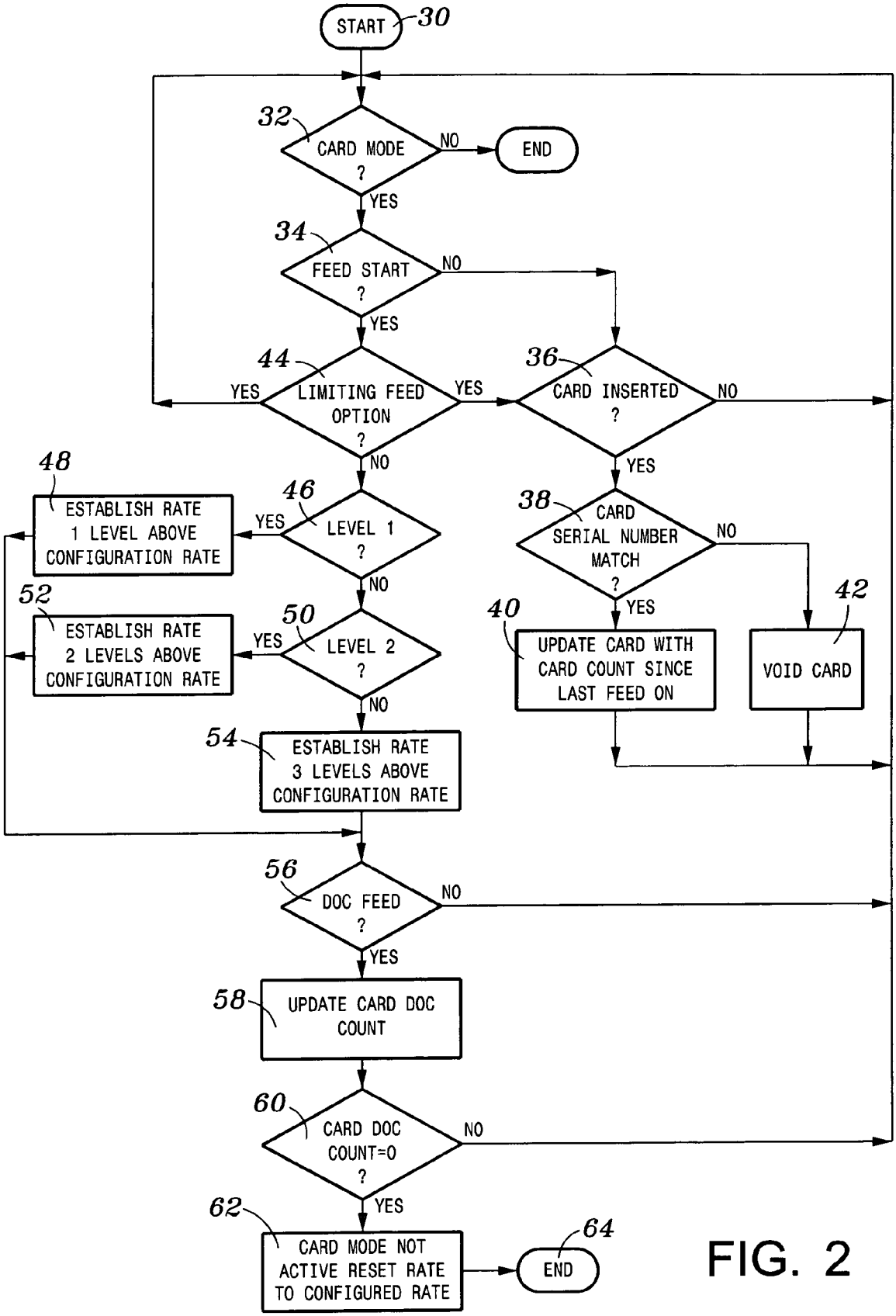
FIG. 2 is a software flow diagram illustrating operation of the present document transport control system.

Referring now to FIG. 2, card manager 20 includes the necessary software for receiving data from card read/write 18, writing data to card 16, providing output controls to throughput control 24 and for controlling display 26. After receiving an indication that a card 16 has been inserted into or swiped by card read/write 18, at start step 30, a decision is made at step 32 to determine whether the transport 12 is in a card mode indicating that transport 12 is operated at multiple throughput rates. If the decision is no, the program ends. If the decision is yes, a decision is made step 34 to determine whether transport 12 can be started. If the decision is no, a determination is made at step 36 to determine whether a card 16 has been properly inserted into card read/write 18. If the decision is no, the card manager 20 routes the program to start step 30. If the decision at card inserted step 36 is yes, card manager 20 determines whether the card 16 serial number matches the serial number of transport 12 at step 38. If the decision is yes, the card 16 document count is updated at step 40 with the card count since the last time document feeder 14 was actuated. If the decision at step 38 is no, the card 16 is determined to be void and control reverts back to start step 30. Although step 38 is utilized as described, to determine a card serial number match, card 16 may also be utilized with any transport 12, and not a specific transport determined by a transport serial number.

If the decision at step 34 is yes, a decision is then made at step 44 to determine whether the transport has a limiting feed option. If the transport cannot be run at throughput rates higher than the preset configured throughput rate, the user cannot utilize a card 16 to change the throughput rate, and control reverts to start step 30.

If there is no limiting feed option determined at step 44, a decision is made at step 46 to determine whether card 16 includes a level 1 throughput rate. A level 1 throughput rate is some predetermined amount greater than the preset throughput rate of transport 12. If the decision at step 46 is yes, the established throughput rate for level 1 is selected by card manager 20 and applied the throughput control 24. If the decision at step 46 is no, a decision is made at step 50 to determine whether card 16 stores a throughput rate of a level 2. The level 2 throughput rate is greater than level 1 throughput rate. If the decision is yes, the level 2 throughput rate is established at step 52. If the decision as step 50 is no, the default condition exists that card 16 stores data of throughput rate level 3 which is greater than the throughput rate of level 2, and at step 54, card manager 20 is configured for throughput rate level 3. Level 3 may also be a rate which is the maximum throughput rate of transport 12.

Once a rate, level 1, level 2 or level 3 is established, a decision is made at step 56 to determine whether any documents have been fed along transport 12. If the decision is no, the system returns to start step 30. If the decision at step 56 is yes, the document count of a card 16 is updated at step 58. A decision is made at step 60 to determine whether the new updated card 16 document count is equal to zero, and, if so, a card 16 can no longer be utilized. Card manager 20, therefore writes to card 16 indicating that the card cannot be used and card manager 20 reconfigures the throughput rate of transport 12 to the preset configured throughput rate at step 62. The program then concludes at the end step 64. If the decision at step 60 is no, indicating that the count for the quantity of documents still remains on a card 16, the program returns to start step 30.

It therefore can be seen that the present document transport control system allows for a user selectable throughput rate based upon the use of a smart card which includes data establishing throughput rates above a preset or configured throughput rate of a transport. The smart card is utilized for a predetermined number of documents to be transported along the transport.

Other alteration and modification of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A document transport control system for controlling the throughput rate of a document transport, the document transport having a preset configured throughput rate, the system comprising:

a smart card for storing data including a throughput rate, wherein data stored on said smart card includes a count of a quantity of documents to be transported by the document transport at the throughput rate stored on said smart card;

a card reader for reading data stored on said smart card; and a controller responsive to data read by said card reader for changing the preset throughput rate to the throughput rate stored on said smart card.

2. The system of claim 1 wherein the throughput rate stored on said smart card is greater than the document transport preset throughput rate.

3. A document transport control system for controlling the throughput rate of a document transport, the document transport having a preset configured throughput rate, the system comprising:

a smart card for storing data including a throughput rate;

a card reader for reading data stored on said smart card;

a controller responsive to data read by said card reader for changing the preset throughput rate to the throughput rate stored on said smart card; and wherein said controller includes a counter for counting a number of documents transported by the document transport at the throughput rate stored on said smart card and for deducting said counted number of documents from the count of the number of documents stored on said smart card using said card reader.

4. A document transport control system for controlling the throughput rate of a document transport, the document transport having a preset configured throughput rate, the system comprising:

a smart card for storing data including a throughput rate;

a card reader for reading data stored on said smart card;

a controller responsive to data read by said card reader for changing the preset throughput rate to the throughput rate stored on said smart card; and a display for displaying the throughput rate and a remaining count of documents stored on said smart card.

5. A document transport control system for controlling the throughout rate of a document transport, the document transport having a preset configured throughput rate, the system comprising:

a smart card for storing data including a throughput rate;

a card reader for reading data stored on said smart card;

a controller responsive to data read by said card reader for changing the preset throughput rate to the throughput rate stored on said smart card; and wherein said data stored on said smart card includes a serial number corresponding to a serial number of the document transport.

6. A document transport control system for a document transport having user selectable transport rates, the document transport having a preselected configured throughput rate, the system comprising:

a plurality of smart cards for storing data, each of said plurality of smart cards storing data representing a different throughput rate, wherein one of said plurality of smart cards stores a first throughput rate and a second of said plurality of smart cards stores a second throughput rate, said second throughput rate being greater than said first throughput rate and wherein said first throughput rate is greater than the preset throughput rate;

a card reader for reading data stored on said plurality of smart cards; and a controller responsive to data read by said card reader for changing the preset throughput rate to the throughput rate stored on one of said plurality of smart cards.

7. A document transport control system for a document transport having user selectable transport rates, the document transport having a preselected configured throughout rate, the system comprising:

a plurality of smart cards for storing data, each of said plurality of smart cards storing data representing a different throughput rate;

a card reader for reading data stored on said plurality of smart cards;

a controller responsive to data read by said card reader for changing the preset throughput rate to the throughput rate stored on one of said plurality of smart cards; and wherein data stored on each of said plurality of smart cards includes a document count of a number of documents to be transported by the document transport at the throughput rate stored on one of said plurality of smart cards.

8. A document transport control system for a document transport having user selectable transport rates, the document transport having a preselected configured throughput rate, the system comprising:

a plurality of smart cards for storing data, each of said plurality of smart cards storing data representing a different throughput rate:

a card reader for reading data stored on said plurality of smart cards;

a controller responsive to data read by said card reader for changing the preset throughout rate to the throughput rate stored on one of said plurality of smart cards; and wherein said controller includes a counter for counting a number of documents transported by the document transport at the throughput rate stored on one of said plurality of smart cards and for deducting said counted number of documents from the count of the number of documents stored on said one of said plurality of smart cards using said card reader.

9. A document transport control system for a document transport having user selectable transport rates, the document transport having a preselected configured throughput rate, the system comprising:

a plurality of smart cards for storing data, each of said plurality of smart cards storing data representing a different throughput rate;

a card reader for reading data stored on said plurality of smart cards;

a controller responsive to data read by said card reader for changing the preset throughput rate to the throughput rate stored on one of said plurality of smart cards; and a display for displaying the throughput rate and a remaining count of the number of documents stored on one of said plurality of smart cards.

10. A document transport control system for a document transport having user selectable transport rates, the document transport having a preselected configured throughput rate, the system comprising:

a plurality of smart cards for storing data, each of said plurality of smart cards storing data representing a different throughput rate;

a card reader for reading data stored on said plurality of smart cards;

a controller responsive to data read by said card reader for changing the preset throughput rate to the throughput rate stored on one of said plurality of smart cards; and wherein said data includes a serial number corresponding to a serial number of the document transport.

* * * * *